US010450621B2

(12) United States Patent
Abrahams

(10) Patent No.: US 10,450,621 B2
(45) Date of Patent: Oct. 22, 2019

(54) LOW ALLOY HIGH PERFORMANCE STEEL

(71) Applicant: Government of the United States, as represented by the Secretary of the Air Force, Wright-Patterson AFB, OH (US)

(72) Inventor: Rachel Ann Abrahams, Crestview, FL (US)

(73) Assignee: United States of America, as represented by the Secretary of the Air Force, Wright-Patterson AFB, OH (US)

( * ) Notice: Subject to any disclaimer, the term of this patent is extended or adjusted under 35 U.S.C. 154(b) by 627 days.

(21) Appl. No.: 15/160,221

(22) Filed: May 20, 2016

(65) Prior Publication Data

US 2016/0369362 A1 Dec. 22, 2016

Related U.S. Application Data

(60) Provisional application No. 62/173,414, filed on Jun. 10, 2015, provisional application No. 62/241,496, filed on Oct. 14, 2015.

(51) Int. Cl.
*C21D 6/00* (2006.01)
*C22C 38/46* (2006.01)
(Continued)

(52) U.S. Cl.
CPC ..... *C21D 6/004* (2013.01); *C21D 1/18* (2013.01); *C21D 1/28* (2013.01); *C21D 1/60* (2013.01); *C21D 6/005* (2013.01); *C21D 6/008* (2013.01); *C21D 8/0226* (2013.01); *C22C 38/001* (2013.01); *C22C 38/002* (2013.01); *C22C 38/02* (2013.01); *C22C 38/04* (2013.01);
(Continued)

(58) Field of Classification Search
None
See application file for complete search history.

(56) References Cited

U.S. PATENT DOCUMENTS 4,855,106 A * 8/1989 Katsumata ..... C22C 38/22 420/109
6,092,989 A * 7/2000 Siga ..... C22C 38/44 415/200

(Continued)

*Primary Examiner* — Xiaowei Su
(74) *Attorney, Agent, or Firm* — AFMCLO/JAZ; Timothy M. Barlow

(57) ABSTRACT

A low alloy, high performance steel having high impact toughness and high ductility, as well as methods of making and heat treating the alloy, are provided. The alloy steel composition consists essentially of about 0.24% to about 0.32% carbon, about 2.00% to about 3.00% chromium, about 0.50% to about 1.50% molybdenum, about 0.05% to about 0.35% vanadium, about 1.00% manganese or less, about 3.00% nickel or less, about 1.50% silicon or less, with minimal impurities, and balance consisting essentially of iron, wherein % is weight percent based on the entire weight of the alloy steel composition. The impurities may include about 0.20% copper or less, about 0.015% phosphorous or less, about 0.012% sulfur or less, about 0.02% calcium or less, about 0.15% nitrogen or less, and/or about 0.025% aluminum or less. Also disclosed is a hardened and tempered article that has high impact toughness, as well as other favorable physical properties.

17 Claims, 8 Drawing Sheets

(51) Int. Cl.

| | |
|---|---|
| ***C22C 38/44*** | (2006.01) |
| ***C22C 38/06*** | (2006.01) |
| ***C22C 38/02*** | (2006.01) |
| ***C22C 38/00*** | (2006.01) |
| ***C21D 1/18*** | (2006.01) |
| ***C21D 1/28*** | (2006.01) |
| ***C22C 38/42*** | (2006.01) |
| ***C22C 38/04*** | (2006.01) |
| ***C21D 1/60*** | (2006.01) |
| ***C21D 8/02*** | (2006.01) |

(52) U.S. Cl.

CPC ..... *C22C 38/06* (2013.01); *C22C 38/42* (2013.01); *C22C 38/44* (2013.01); *C22C 38/46* (2013.01); *C21D 2211/001* (2013.01); *C21D 2211/008* (2013.01)

(56) References Cited

U.S. PATENT DOCUMENTS

2003/0116240 A1* 6/2003 Fujita ..... C21D 9/38
148/639
2004/0250931 A1* 12/2004 Dilmore ..... C21D 1/18
148/633

* cited by examiner

LOW ALLOY HIGH PERFORMANCE STEEL

CROSS-REFERENCE TO RELATED APPLICATIONS

The present application claims priority to U.S. Provisional Patent Application Ser. Nos. 62/173,414 filed on Jun. 10, 2015 and 62/241,496 filed on Oct. 14, 2015, each of which is incorporated herein by reference in its entirety.

RIGHTS OF THE GOVERNMENT

The invention described herein may be manufactured and used by or for the Government of the United States for all governmental purposes without the payment of any royalty.

FIELD OF THE INVENTION

The present invention relates to low alloy, high performance steel, and more particularly to high strength, low alloy steel having high impact toughness at low temperatures along with high ductility.

BACKGROUND OF THE INVENTION

There is a need in the art for a low cost, high strength, high performance steel composition. Such high strength, high performance steels have various applications in both the commercial and military industries. For example, commercial applications of high strength, high performance steels include the following: pressure vessels; hydraulic and mechanical press components; commercial aircraft frame and landing gear components; locomotive, automotive, and truck components, including die block steels for manufacturing of components; and bridge structural members. Exemplary military application of high strength, high performance steels include hard target penetrator warhead cases, missile components including frames, motors, and ordnance components including gun components, armor plating, military aircraft frame and landing gear components. In particular, there is a need for steels that are capable of maintaining strength and toughness across relatively thick (e.g., >2") sections.

One major disadvantage to traditional high strength, high performance steels is the relatively high cost of the steel, which arises from the alloy content, as well as the expensive manufacturing processes associated with such high performance steels. To produce high strength steel, prior art compositions generally contain high levels of nickel, tungsten, and/or cobalt, which are relatively expensive elements and contribute to the high overall cost of the final steel product.

For example, to produce strength and toughness combinations, traditional steels often contain significant amounts of nickel and cobalt, often totaling more than 15% of the alloy combinations. Other alloy steels contain difficult to process alloy additions, such as tungsten. One prior art composition, commonly designated as Eglin Steel and described in U.S. Pat. No. 7,537,727, contains up to 3.25% tungsten, which is expensive, limited in supply, and difficult to process due to the high melting point and very high density of the master alloy. The propensity of Eglin Steel to form detrimental, stable, tungsten containing carbides also makes the material difficult and expensive to process. The addition of tungsten also complicates waste stream/recycling capability of the alloy. Another prior art composition, commonly designated as AF-1410 and described in U.S. Pat. No. 4,076,525, provides a high strength, high performance steel at an expensive cost due to the high weight percentage of nickel, which contains 10% nickel as well as about 14% cobalt to achieve the desired high performance metrics. Another alloy composition, described in U.S. Patent Appl. Publ. No. 2010/0018613, provides a high strength, high toughness FeCuNiCr alloy steel that includes 0.35% to 0.55% carbon, 0.5% to 0.6% copper, 3.5% to 7.0% nickel, and 0.75% to 2.0% chromium, as well as requiring specific weight ratios of silicon (Si), copper (Cu), vanadium (V), and niobium (Nb) that satisfy a specified formula:

$$2(\%\ Si+\%\ Cu)/(\%\ V+5/9\times\%\ (Nb)\leq 14.$$

However, these prior art alloys are too cost-prohibitive to be used and manufactured on the scale required for penetrating weapons. In some cases, high-strength, high toughness steels are very difficult to process in thick sections. In view of the foregoing, a need exists for a high performance alloy steel composition that meets rigorous physical requirements and is easy and/or inexpensive to process.

SUMMARY OF THE INVENTION

The present invention overcomes one or more of the existing needs in the prior art by providing a low alloy, low to medium carbon content, and low nickel content steel composition, which exhibits similarly desirable high performance characteristics of high strength steel compositions known in the prior art, and which can be produced according to current "state-of-the-art" production techniques at substantially lower costs (e.g., atmosphere ladle melting versus vacuum melting techniques).

In accordance with an embodiment of the present invention, a high strength, low alloy steel composition is provided. The alloy steel composition consists essentially of about 0.24% to about 0.32% carbon, about 2.00% to about 3.00% chromium, about 0.50% to about 1.50% molybdenum, about 0.05% to about 0.35% vanadium, about 1.00% manganese or less, about 3.00% nickel or less, about 1.50% silicon or less, about 0.20% copper or less, about 0.015% phosphorous or less, about 0.012% sulfur or less, about 0.02% calcium or less, about 0.15% nitrogen or less, about 0.025% aluminum or less, and balance iron, wherein % is weight percent based on the entire weight of the alloy steel composition.

In accordance with another embodiment of the present invention, a method of thermally processing the alloy steel composition is provided. The method includes austenitizing a sample of the alloy steel composition by heating the sample to an austenitizing temperature that is above a critical temperature to form an austenite mixture; lowering the austenite mixture to a temperature below a martensitic-forming temperature to provide an austenitized alloy steel composition; and tempering the austenitized alloy steel composition. The tempering step includes heating the austenitized alloy steel composition to a tempering temperature, which is in a tempering temperature range that is less than about 500° F. (260° C.) but greater than about 350° F. (177° C.), at a rate of about 400° F. (204° C.) per hour or less; maintaining the alloy steel composition in the tempering temperature range for a first duration that is dependent upon a thickness and a length of the sample of the alloy steel composition; and lowering the alloy steel composition to an ambient temperature.

The alloy steel composition thermally processed in accordance with the foregoing method has at least one of the following properties: an ultimate tensile strength of about 200 ksi or more; a yield strength at 0.2% offset of about 170 ksi or more; an elongation to failure of about 10% or more; an impact toughness as measured by a Charpy V-notch test @−40° C. of about 20 ft-lbs or more, or a Hardness Rockwell C-scale of about 45 or more. In another embodiment, the alloy steel composition thermally processed in accordance with the foregoing method can possess two, three, four, or all five of the recited properties. In addition, the properties of the alloy steel composition can be maintained in cross sections greater than 2" in depth.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawing, which is incorporated in and constitute a part of this specification, illustrates an embodiment of the invention and, together with a general description of the invention given above, and the detailed description given below, serve to explain the invention.

DETAILED DESCRIPTION OF THE INVENTION

Figure 1:
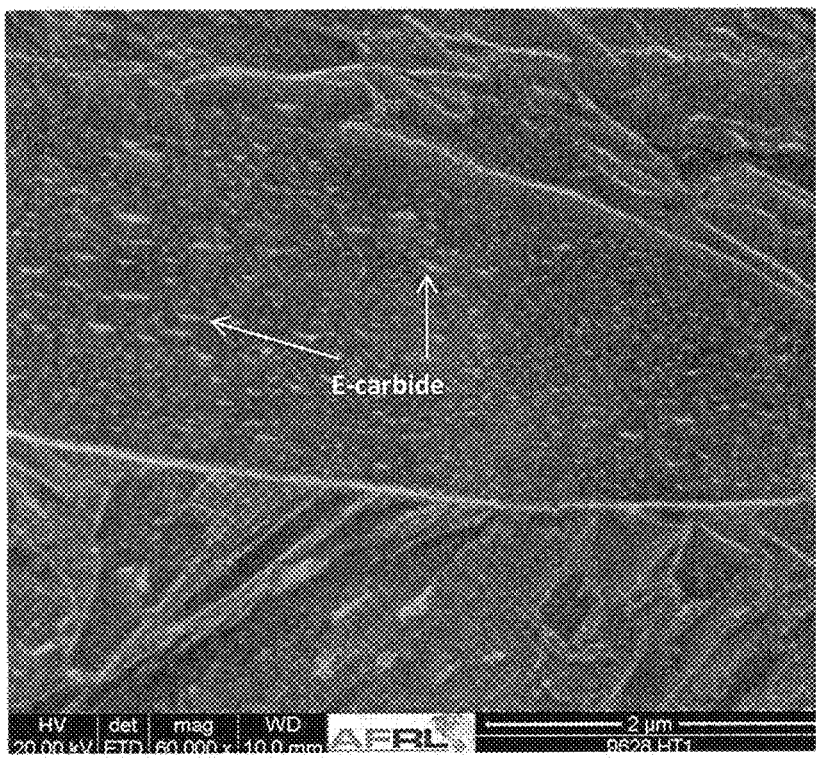
FIG. 1 is a scanning electron micrograph taken at 60,000× showing nanoscale epsilon carbide within a primarily martensitic matrix grain structure, in accordance with an embodiment of the present invention.

Embodiments of the present invention overcome an existing need in the prior art by providing a high strength, low carbon and nickel, alloy steel composition, which exhibits similar high performance and characteristics to the high strength steels described in the prior art. In many alloys, static strength (such as in tool steels) is a measure of performance. In the case of penetrating munitions, both high strength and dynamic toughness at flight temperatures (e.g., −40° C.) must be achieved for good performance. The alloy steel composition can be produced using current "air-melt" production processes, at a substantially lower cost. This includes vacuum-degassed open ladle techniques, argon-oxygen decarburization techniques, as opposed to the relatively more expensive vacuum-induction-melting/vacuum-air-remelting techniques required by most high performance Ni—Co alloys. Without being bound by any particular theory, the alloy is believed to be strengthened by special metastable nano-carbide filamentous rods that are precipitated within a primarily martensitic matrix, which arise from the recited ingredients and their respective amounts and are stabilized by the heat treatment described herein. The alloy steel composition can be heat treated, welded, and produced in both a shape cast and wrought form. Because of these aforementioned properties, the cost of manufacturing bomb cases is significantly reduced for hard target penetrators.

In accordance with embodiments of the present invention, the alloy steel composition consists essentially of about 0.24% to about 0.32% carbon, about 2.00% to about 3.00% chromium, about 0.50% to about 1.50% molybdenum, about 0.05% to about 0.35% vanadium, about 1.00% manganese or less, about 3.00% nickel or less, about 1.50% silicon or less, with the balance of the intentionally added materials being essentially iron, wherein % is weight percent based on the entire weight of the alloy steel composition (see Table 1). The combinations of alloying elements are important and provide desirable effects in the alloy steel composition, as further discussed below. Copper, phosphorous, sulfur, calcium, and nitrogen should be kept as low as possible. For example, about 0.20% copper or less, about 0.015% phosphorous or less, about 0.012% sulfur or less, about 0.02% calcium or less, about 0.15% nitrogen or less, and about 0.025% aluminum or less. In another embodiment, the sum total of phosphorus, tin, arsenic, and antimony is equal to or less than about 0.035% (i.e., $P+Sn+As+Sb \leq 0.035\%$), wherein % is weight percent based on the entire weight of the alloy steel composition.

Generally, the amount of each intentionally-added component, as well as any unavoidable impurities, may be determined in accordance with industry accepted methods, such as ASTM E415, which is the test method for analysis of carbon and low alloy steel by Spark Atomic Emission Spectrometry, and ASTM E1019, which includes test methods for carbon, sulfur, nitrogen and oxygen by fusion and combustion.

TABLE 1

Alloy Steel Composition Content by Weight (%)

| Element | Approximate Percentage by Weight (%) |
|---|---|
| Carbon (C) | 0.24 to 0.32 |
| Chromium (Cr) | 2.00 to 3.00 |
| Molybdenum (Mo) | 0.50 to 1.50 |
| Vanadium (V) | 0.05 to 0.35 |
| Manganese (Mn) | 1.00 or less |
| Nickel (Ni) | 3.00 or less |
| Silicon (Si) | 1.25 or less |
| Copper (Cu) | 0.15 or less |
| Phosphorous (P) | 0.015 maximum |
| Sulfur (S) | 0.02 maximum |
| Calcium (Ca) | 0.02 maximum |
| Nitrogen (N) | 0.15 maximum |
| Aluminum (Al) | 0.025 maximum |
| Iron (Fe) | Balance |

Carbon contributes to the high strength and hardness capability provided by the alloy. Carbon is also beneficial to the hardenability of this alloy. However, too much carbon adversely affects the toughness provided by the alloy. Too much carbon also affects the sensitivity to quench cracking and defects. Therefore, in one embodiment, carbon is present in an amount of about 0.24% but not more than about 0.32%. In another embodiment, carbon is present in an amount of about 0.26% but not more than about 0.30%; or about 0.26% but not more than about 0.29%. For example, carbon may be present in about 0.24%, about 0.25%, about 0.26%, about 0.27%, about 0.28%, about 0.29%, about 0.30%, about 0.31%, about 0.32%, or within a range between any two of the foregoing amounts.

Chromium contributes to the good hardenability, high strength, and temper resistance provided by the alloy steel composition. Thus, in accordance with embodiments of the present invention, the alloy steel composition contains chromium in about 2.00% but not more than about 3.00%. In another embodiment, chromium is present in an amount of about 2.20% but not more than 2.80%; or about 2.50% but not more than about 2.80%. For example, chromium may be present in about 2.00%, about 2.10%, about 2.20%, about 2.30%, about 2.40%, about 2.50%, about 2.60%, about 2.70%, about 2.80%, about 2.90%, about 3.00%, or within a range between any two of the foregoing amounts.

Molybdenum contributes to the solid solution strengthening, prevention of embrittlement, and improved fracture toughness. However, excessive molybdenum leads to segregation and increased stabilization of bainite. Molybdenum also contributes to the stability of detrimental $M_{23}C_6$ carbides (M=metal) at temperatures just below the austenitization transformation temperature. Thus, in accordance with embodiments of the present invention, the alloy steel composition contains molybdenum in about 0.50% but not more than about 1.50%. In another embodiment, molybdenum is present in an amount of about 0.75% but not more than about 1.25%; or about 0.85% but not more than 1.05%. For example, molybdenum may be present in about 0.50%, about 0.60%, about 0.70%, about 0.75%, about 0.80%, about 0.90%, about 1.00%, about 1.05%, about 1.10%, about 1.20%, about 1.30%, about 1.40%, about 1.50%, or within a range between any two of the foregoing amounts.

Vanadium contributes to the high strength and good hardenability provided by this alloy steel composition. Vanadium is an intentional addition to stop grains from growing at the high temperature treatment. More specifically, vanadium is used for grain boundary pinning to prevent excessive grain growth during high temperature heat treatment events and preserves associated mechanical properties. However, too much vanadium may adversely affect the work-hardening capability of the alloy through the formation of carbides that increase the yield/tensile strength ratio. In addition, excessive vanadium leads to over-stabilization of grain pinning MC carbides, leading to reduced impact toughness at −40° C., as they are difficult to dissolve. Thus, in accordance with embodiments of the present invention, the alloy steel composition contains vanadium in about 0.05% but not more than about 0.35%. In another embodiment, vanadium is present in an amount from about 0.05% but not more than about 0.25%; or about 0.05% but not more than about 0.15%. For example, vanadium may be present in about 0.05%, about 0.07%, about 0.09%, about 0.10%, about 0.15%, about 0.17%, about 0.19%, about 0.21%, about 0.25%, about 0.27%, about 0.29%, about 0.31%, about 0.35%, or within a range between any two of the foregoing amounts.

It has been found that manganese also benefits the high strength provided by the alloy. However, if too much manganese is present, excessive manganese segregation and banding can occur, leading to formation undesirable secondary phases that affect both strength and toughness. Thus, in accordance with embodiments of the present invention, the alloy steel composition contains manganese in about 1.00% or less. In another embodiment, manganese is present in an amount from about 0.10% but not more than about 0.90%; or about 0.50% but not more than about 0.80%. For example, manganese may be present in about 0.05%, about 0.10%, about 0.20%, about 0.25%, about 0.30%, about 0.40%, about 0.50%, about 0.60%, about 0.70%, about 0.75%, about 0.80%, about 0.90%, about 1.00%, or within a range between any two of the foregoing amounts.

Nickel is beneficial to the good low temperature (e.g., −40° C.) toughness provided by the alloy steel composition. The benefit provided by larger amounts of nickel adversely affects the cost of this alloy steel composition without providing a significant advantage. Thus, in accordance with embodiments of the present invention, nickel is restricted to about 3.00% or less. In another embodiment, nickel is present in an amount from about 0.50% but not more than about 2.50%; or about 0.90% but not more than about 1.2%. For example, nickel may be present in about 0.10%, about 0.30%, about 0.50%, about 0.60%, about 0.80%, about 0.90%, about 1.00%, about 1.10%, about 1.30%, about 1.5%, about 1.75%, about 2.00%, about 2.25%, about 2.50%, about 2.75%, about 3.00%, or within a range between any two of the foregoing amounts.

Silicon benefits the hardenability and temper resistance of this alloy. Silicon is added to reduce coarsening of epsilon carbide to cementite. By preserving smaller, semi-coherent carbides, silicon enhances toughness. However, too much silicon adversely affects the hardness, strength, and ductility of the alloy steel composition through over-stabilization of bainitic phases. Thus, in accordance with embodiments of the present invention, the alloy steel composition contains silicon in about 1.5% or less. In another embodiment, silicon is present in an amount from about 0.50% but not more than about 1.25%; or about 0.90% but not more than about 1.10%. For example, silicon may be present in about 0.10%, about 0.20%, about 0.30%, about 0.40%, about 0.50%, about 0.60%, about 0.70%, about 0.80%, about 0.90%, about 1.0%, about 1.10%, about 1.20%, about 1.25%, about 1.30%, about 1.40%, about 1.50%, or within a range between any two of the foregoing amounts.

Copper is an impurity commonly found in recycled steel material. Recycled steel returns are commonly used as a component of high strength low alloy steel. However, too much copper can result in precipitation of an undesirable amount of free copper in the alloy matrix and adversely affect the fracture toughness of the alloy. Therefore, in accordance with embodiments of the present invention, copper is present in an amount of about 0.20% or less. In an embodiment, copper is present in an amount of about 0.15% or less, about 0.10% or less, about 0.08% or less, or about 0.05% or less.

In another embodiment, about 0.01% or less of niobium is present, for example less than about 0.005%, or about 0.004%.

The balance of the alloy steel composition is essentially iron and the usual and/or unavoidable impurities typically found in commercial grades of similar alloys and steels. The combination and amounts of the foregoing elements are important and provide desirable effects in the alloy steel composition, which includes good ultimate tensile strength, yield strength, elongation to failure, impact toughness, and/or hardness.

The alloy steel composition may also contain a small amount of phosphorus, sulfur, calcium, nitrogen, or aluminum, which can remain as impurities after final melt processing. For example, in accordance with embodiments of the present invention, the content of phosphorous may be limited to about 0.015% or less, or about 0.010% or less, or about 0.008% or less; the content of sulfur may be limited to about 0.012% or less, or about 0.010% or less, about 0.005% or less, or about 0.001% or less; the content of calcium may be limited to about 0.02% or less, about 0.015% or less, or about 0.01% or less; the content of nitrogen may be limited to about 0.15% or less, about 0.10% or less, about 0.05% or less, or about 0.01% or less; and the content of aluminum may be limited to about 0.025% or less, about 0.020% or less, about 0.015% or less, or about 0.010% or less. In accordance with another embodiment, other incidental impurities may also be present in small (e.g., ≤0.01% or less) quantities.

In accordance with an embodiment, the weight ratios of silicon (Si), copper (Cu), vanadium (V), and niobium (Nb) may not fall within a formula $$2 \leq (\%\ Si + \%\ Cu)/(\%\ V + 5/9 \times \%\ Nb) \leq 10.$$

One unexpected advantage of the present alloy steel composition is the realization of the desirable physical properties using relatively low levels of nickel. And according to an embodiment of the present invention, the alloy steel composition is void of any intentionally added tungsten or cobalt. In another embodiment, the alloy steel composition is void of any tungsten or cobalt. In yet another embodiment, tungsten and/or cobalt may be present in an amount that does not detrimentally affect the physical properties of the alloy steel composition that has been heat treated in accordance to the method disclosed herein. For example, in an embodiment, residual amounts of tungsten or cobalt (e.g., 0.40 wt % or less, or 0.75% or less, respectively), introduced intentionally or by way of contamination during the melt process, may be tolerated. In yet another embodiment, tungsten and/or cobalt may be present in an amount of about 0.1% or less.

The combination of the alloying elements (i.e., carbon, chromium, molybdenum, vanadium, manganese, nickel, and silicon) in the disclosed amounts and relative ratios, along with the heat treatment described herein, leads to a desirable mixed precipitation of a metastable ε-carbide and cementite within a primarily martensitic matrix, which optionally may contain bainite as a minor constituent (e.g., about 15% or less) of the matrix. ε-carbide is a nano-sized iron-rich, metastable, semi-coherent carbide within the matrix as opposed to the matrix, and leads to increased strength with reduced losses of toughness. In accordance with an embodiment, the alloy steel composition may be substantially void of any typical tool-steel alloy carbides, such as $M_{23}C_6$, $M_2C$, and $M_6C$ carbides. Accordingly, the alloy steel composition differs from the Eglin Steel examples provided in U.S. Pat. No. 7,537,727, which are believed to be strengthened by primarily small cementite, and AF-1410, which is strengthened by a high temperature, molybdenum-rich carbide ($M_2C$). A scanning electron microscope (SEM) image is provided in FIG. 1 to demonstrate the shape and distribution of this ε-carbide within the primarily martensitic matrix. Retained austenite, a phase seen in several other high strength steels, is intentionally kept at a minimum (e.g., less than about 10%); this is unique as compared to standard Ni—Cr—Mo grades.

The alloy steel composition of the present invention can be manufactured by multiple current alloy production processes including Vacuum Induction Melting (VIM), Vacuum Arc Remelting (VAR), Electro Slag Re-melting (ESR), Argon Oxygen Decarburization Assisted Melting and Electric Arc (AODAME), Open-Ladle Vacuum Degas Melting (OLVDG), and Casting. In one example, the alloy steel composition is manufactured by using a VIM process. In another example, the alloy steel composition is manufactured using the OLVDG method. For medium liability items, AODAME and VAR may be used. For high liability items, the material may be melted using VAR+ESR techniques or VIM with VAR methods.

In an embodiment of the present invention, the alloy steel composition may be forged into a desired shape, followed by the heat treatment process described herein. In another embodiment of the present invention, the alloy steel composition may be shape casted into a desired shape, followed by the heat treatment process described herein. If casted, a hot isostatic pressing (HIP) step may be performed after shaping but prior to the heat treatment process. The HIP treatment is intended to squeeze out residual porosity left from shape casting.

Heat Treatment

General steps for heat treating any alloy steel composition can include a normalizing step; an austenitizing step that includes a quenching step; and a tempering step. In some instances, one or more physical properties of the alloy steel composition may be improved by incorporating a subcritical treatment step prior to austenitizing.

Thus, in accordance with another embodiment of the present invention, a method of heat treating the alloy steel composition of the present invention is provided. The method includes austenitizing a sample of the alloy steel composition by heating the sample to an austenitizing temperature that is above a critical temperature to form an austenite mixture; rapidly lowering the austenite mixture to a temperature below a martensitic-forming temperature; and tempering the austenitized alloy steel composition.

In accordance with an aspect of the invention, the foregoing alloy steel composition, upon undergoing a heat treatment process as described herein, provides a material having an ultimate tensile strength (UTS) of about 200 ksi or more; a yield strength (YS) at 0.2% offset of about 170 ksi or more; an elongation to failure (EF) of about 10% or more; an impact toughness as measured by a Charpy V-notch (CVN) test @−40° C. of about 20 ft-lbs or more; and/or a Hardness Rockwell (HR) C-scale of about 45 or more. In another embodiment, the alloy steel composition thermally processed in accordance with the disclosed heat treatment can possess two, three, four, or all five of the recited properties.

In one aspect, UTS of the alloy steel composition may be about 210 ksi or more, or 220 ksi or more, or 230 ksi or more. In another aspect, the YS of the alloy steel composition may be about 175 ksi or more, or about 180 ksi or more. In another aspect, the EF of the alloy steel composition may be about 10.5% or more, or about 11% or more. In another aspect, the impact toughness as measured by the CVN test @−40° C. of the alloy steel composition may be about 22 ft-lbs or more, or about 24 ft-lbs or more. In yet another aspect, the HR of the alloy steel composition may be about 46 or more, or about 47 or more.

In accordance with another embodiment, the heat-treated alloy steel composition has an ultimate tensile strength of about 230 ksi or more; a yield strength at 0.2% offset of about 180 ksi or more; an elongation to failure of about 11% or more; and/or an impact toughness as measured by a Charpy V-notch test @−40° C. of about 24 ft-lbs or more; and/or a Hardness Rockwell C-scale of about 45 or more.

Austenitizing Treatment

In accordance with an embodiment, the austenitizing step includes charging the sample of the alloy steel composition into a second furnace below about 500° F. (about 260° C.); heating the alloy steel composition to an austenitizing temperature range that is greater than a critical temperature, (e.g., at a rate of about 300° F. (about 149° C.) per hour or less); maintaining the alloy steel composition in the austenitizing temperature range for a second duration that is dependent upon the thickness and the length of the sample of the alloy steel composition; and quenching the alloy steel composition from the austenizing temperature range to below a martensitic forming temperature in liquid selected from the group consisting of water, an aqueous solution, an oil, a polymer liquid, and combinations thereof. In one aspect, the critical temperature may be about 1750° F. (about 954° C.) or higher, and thus the austenizing temperature is higher, e.g., about 1760° F. (960° C.), about 1775° F. (967° C.), about 1800° F. (982° C.), about 1825° F. (996° C.), about 1850° F. (1010° C.), about 1875° F. (1024° C.), or about 1900° F. (1038° C.). In another aspect, the martensitic-forming temperature may be about 150° F. (66° C.) or less, e.g., about 145° F. (63° C.) or less, about 140° F. (60° C.) or less, about 135° F. (57° C.) or less, about 130° F. (54° C.) or less, about 125° F. (52° C.) or about, or about 120° F. (49° C.) or less. In one aspect, the heating rate or ramp speed of the oven may be maximized between the temperatures of about 600° F. (316° C.) to about 1650° F. (899° C.), so as to minimize or prevent the formation of the more stable, undesirable carbides (i.e., typical tool-steel alloy carbides, such as $M_{23}C_6$, $M_2C$, and $M_6C$ carbides).

In yet another aspect, the duration for maintaining the sample at the austenitizing temperature can vary, for example, a minimum of 30 min/in of sample section size using 1" of 1.5" samples. For example, the sample may be maintained within the austenitizing temperature range for a minimum of about 1 hour, about 2 hours, or about 3 hours.

With respect to the quenching step, the temperature of the alloy steel composition is rapidly lowered from the austenizing temperature range to below a martensitic forming temperature (e.g., about 150° F. (66° C.) or lower) in liquid quenchant selected from the group consisting of water, an aqueous solution, an oil, a polymer liquid, and combinations thereof. Many of the undesirable carbides for the penetrator type applications require significant driving force/energy, and therefore time at temperature to form. To avoid these undesirable carbide phases, cooling from step 1 (i.e., austenitizing step) is performed very quickly. For example, a water or polymer quench is used for samples of AF9628 having a thickness greater than about 1". For these samples having a thickness greater than about 1", an oil quench, as is typically practiced, may be too slow. Rapid intensive gas quenches, with inert gases such as nitrogen, argon, helium, or combinations thereof, may be used for thin (e.g., <0.25") parts if a martensitic structure can be assured.

Traditionally, one of the most common numerical expressions for quench severity is the Grossmann H-Value, which reflects the relative ability of a quenchant to harden steel. (See Totten, Quenching Theory and Technology, 2nd Edition.) In one aspect, the Grossmann H-Value of the liquid quenchants is about 0.25 or greater.

Tempering Treatment

In accordance with embodiments of the present invention, a low temperature tempering is used to reduce the driving force for the formation of the more stable, undesirable carbides (i.e., typical tool-steel alloy carbides, such as $M_{23}C_6$, $M_2C$, and $M_6C$ carbides). Accordingly, the tempering temperature may be within a range from greater than about 350° F. (177° C.) to less than about 500° F. (260° C.). In an embodiment, the tempering step includes charging the alloy steel composition into a first furnace below about 400° F. (204° C.); heating the alloy steel composition to a tempering temperature of less than about 500° F. (260° C.) at a rate of about 400° F. (204° C.) per hour or less; maintaining the alloy steel composition at the tempering temperature for a first duration that is dependent upon a thickness and a length of the sample of the alloy steel composition; and lowering the sample of the alloy steel composition to an ambient temperature.

In one aspect, the tempering temperature may be limited to about 485° F. (252° C.) or less, about 475° F. (246° C.) or less, about 465° F. (241° C.) or less, about 450° F. (232° C.) or less, about 435° F. (224° C.) or less, about 425° F. (218° C.) or less, about 415° F. (213° C.) or less, or about 400° F. (204° C.) or less. In another aspect the tempering temperature may be greater than about 350° F. (177° C.), e.g., about 360° F. (182° C.) or more, about 370° F. (188° C.) or more, about 375° F. (191° C.) or more, about 380° F. (193° C.) or more, about 390° F. (199° C.) or more. Accordingly, the tempering temperature may be about 375° F. (191° C.), about 385° F. (196° C.), about 390° F. (199° C.), about 400° F. (204° C.), about 410° F. (210° C.), about 415° F. (213° C.), about 425° F. (218° C.), about 435° F. (224° C.), about 450° F. (232° C.), or within a range between any of the foregoing (e.g., about 390° F. (199° C.) to about 410° F. (210° C.). In another aspect, the tempering duration can vary, for example, a minimum of 1 hr/in of sample section size using 1" to 1.5" thick samples or for a minimum duration of about 3 hours. For example, tempering has been performed to 24 hours with no detrimental change in properties, particularly toughness. Following the tempering duration, the samples may be permitted to cool in air, or cooled by water or other media (e.g., oil, polymer).

Additionally, a normalizing and/or a subcritical heat treatment, as discussed in more detail below, may precede the austenitizing step.

Normalizing Treatment

With respect to the normalizing treatment, the step includes charging the sample of the alloy steel composition into a third furnace below about 500° F. (260° C.); heating the alloy steel composition to a normalizing temperature range that is about 1825° F. (996° C.) to about 1875° F. (1024° C.), at a rate of about 300° F. (149° C.) per hour or less; maintaining the alloy steel composition within the normalizing temperature range for a third duration that is dependent upon the thickness and the length of the sample of the alloy steel composition; and allowing the alloy steel composition to air cool from the normalizing temperature range. The duration for maintaining the sample at the normalizing temperature can vary, for example, a minimum of 30 min/in of sample section size using 1" of 1.5" samples.

Subcritical Treatment

Without being bound by any particular theory, this treatment step may be added to decrease the prior austenite grain size from previous high temperature treatments through the precipitation of carbides that pin grain boundaries while dissolving into the matrix during subsequent heat treatment stages. Analysis of specimens before and after being subjected to subcritical treatment processing suggests that this step provides a grain size refinement (e.g., 25% or better). It is also suggested that the subcritical step assures that any excessive retained austenite is transformed to bainite before the final austenitization step, enhancing the grain refinement of the material.

When utilized, the subcritical treatment includes charging the sample of the alloy steel composition into a furnace below about 500° F. (260° C.); heating the alloy steel composition to a subcritical temperature range from about 1225° F. (663° C.) to about 1275° F. (691° C.), at a rate of about 300° F. (149° C.) per hour or less; maintaining the alloy steel composition within the range of about 1225° F. (663° C.) to about 1275° F. (691° C.) for a duration that is dependent upon the thickness and the length of the sample of the alloy steel composition; and quenching the alloy in water, or suitable oil/polymer liquid to about 150° F. (66° C.) or less. In one embodiment, the duration for holding the sample within the subcritical treatment range may be for about 4 hours or more.

Hot Isostatic Pressing (HIP)

The Hot Isostatic Pressing (HIP) step is used when the material is shape casted. This step closes inherent porosity in castings, which are detrimental to elongation and v-notch toughness. In an embodiment, the HIP processing temperatures are between about 1925° F. (1052° C.) to about 2125° F. (1163° C.). HIP pressures are approximately 15 ksi (e.g., 10 ksi to 20 ksi), and HIP process durations are about 2 hours to about 4 hours. Parts are cooled from the HIP temperature by using an inert gas (e.g., argon) cooling step.

The alloy steel composition thermally processed in accordance with the foregoing method has at least one of the following properties: an ultimate tensile strength of about 220 ksi or more; a yield strength at 0.2% offset of about 170 ksi or more; an elongation to failure of about 10% or more; an impact toughness as measured by a Charpy V-notch test @−40° C. of about 20 ft-lbs or more, or a Hardness Rockwell C-scale of about 45 or more. In another embodiment, the thermally-treated alloy steel composition is characterized by having each of the foregoing physical properties.

The alloy of the present invention is useful in a wide range of applications. The very high strength and good fracture toughness of the alloy makes it useful for machine tool components and also in structural components for aircraft, including landing gears. The alloy of this invention is also useful for automotive components including, but not limited to, structural members, drive shafts, springs, and crankshafts. It is believed that the alloy also has utility in ballistic armor plate, sheet, and bars.

EXAMPLES

The high strength, high toughness, and high ductility alloy steel composition having a low to medium carbon content described herein and as exemplified in Tables 1-6, is also called "AF9628" or "USAF9628". The disclosed embodiments of AF9628 contain low levels of nickel (e.g., about 3% or less), no added cobalt, and no added tungsten, yet maintains the performance characteristics associated with steel compositions that contain high levels of nickel, cobalt, or contain tungsten. The present invention is explained and illustrated more specifically using the following examples:

Composition (A)—Vacuum Induction Heat

A sample of AF9628 (approximately 100 lbs to 200 lbs) was produced according to the composition provided in Table 2 using a vacuum induction heat technique. The materials/ingredients were melted together to form AF9628 composition (A) using a vacuum induction furnace with no additional refinement. Samples of AF9628 composition (A) were then forged and rolled into about 1.5" thick×8"×6" plates with reduction ratio greater than about 3:1 ratio. Composition A was used in Example 1.

TABLE 2

AF9628 Composition (A) used in Example 1.

| C (%) | Mn (%) | P (%) | S (%) | Si (%) | Cr (%) | Ni (%) | Mo (%) | Al (%) | Cu (%) | V (%) | Fe (%) | N (ppm) |
|---|---|---|---|---|---|---|---|---|---|---|---|---|
| 0.28 | 0.62 | 0.002 | 0.004 | 0.96 | 2.52 | 0.95 | 0.91 | 0.013 | 0.01 | 0.064 | Bal | 66 |

Example 1

The 1.5" thick×6"×8" plate samples of AF9628 composition (A) were then thermally processed using the following process: (i) charging the samples into a furnace below about 500° F. (260° C.); (ii) heating the samples at about 300° F. (149° C.) per hour maximum to about 1825° F. (996° C.) to about 1875° F. (1024° C.) and (iii) holding the samples for about 30 minutes per inch of thickness at about 1850° F. (1010° C.). Next, the samples were water quenched to below about 125° F. (52° C.). Next the samples were tempered within 24 hours of quenching by (i) heating the samples at a maximum of about 300° F. (149° C.) per hour and (ii) holding the samples for a minimum of about 60 min per inch of sample size at about 400° F. (204° C.) or about 3 hours, whichever is greater, and then allowing the samples to cool in air at room temperature.

Composition (B)—Open Ladle, Vacuum Degassed Heat

Another batch of AF9628 was produced according to the composition provided in Table 3 using an open ladle, vacuum degassed electric arc melted heat to provide the AF9628 composition (B). The materials/ingredients were melted together to form the AF9628 composition (B) in a 240,000 lb. production representative open-ladle vacuum degassed heat. Samples of AF 9628 composition (B) were then forged from ingots into about 15" diameter production bars from and cut into about 2.5" thick ring sections from the outer diameter. Composition B was used in Examples 2-5.

TABLE 3

AF9628 Composition (B) used in Examples 2-5.

| C (%) | Mn (%) | P (%) | S (%) | Si (%) | Cr (%) | Ni (%) | Mo (%) | Al (%) | Cu (%) | V (%) | Fe (%) | N (ppm) |
|---|---|---|---|---|---|---|---|---|---|---|---|---|
| 0.27 | 0.58 | 0.008 | 0.001 | 1.00 | 2.74 | 1.00 | 0.95 | 0.015 | 0.15 | 0.056 | Bal | 54 |

Example 2

A portion of the 2.5" thick ring samples of AF9628 composition (B) were thermally processed using the following process:

Normalizing step: (i) The samples were charged into a furnace below about 500° F. (260° C.); (ii) heated at a maximum rate of about 300° F. (149° C.) per hour to temperature of about 1825° F. (996° C.) to about 1875° F. (1024° C.); and (iii) held for about 30 minutes per inch of thickness at about 1850° F. (1010° C.), followed by an air cool.

Austenitizing step: Next, the samples were (i) charged into a furnace below about 500° F. (260° C.); (ii) heated at a rate of about 300° F. (149° C.) per hour maximum to about 1825° F. (996° C.) to about 1875° F. (1024° C.) and (iii) held for about 30 minutes per inch of thickness at about 1850° F. (1010° C.). Next, the samples were water quenched to below about 125° F. (52° C.).

Tempering step: Next the samples were (i) placed in a furnace below about 400° F. (204° C.), were tempered within 24 hours of quenching by (ii) heating the samples at a maximum of about 400° F. (204° C.) per hour and holding the samples at about 400° F. (204° C.) for a minimum of about 60 min/in of sample size and allowing the samples to cool in air at room temperature.

Example 3

A portion of the 2.5" thick ring samples of AF9628 composition (B) were thermally processed using the following process:

Normalizing step: (i) The samples were charged into a furnace below about 500° F. (260° C.); (ii) heated at about 300° F. (149° C.) per hour maximum to about 1825° F. (996° C.) to about 1875° F. (1024° C.) and (iii) held for about 30 minutes per inch of thickness at about 1850° F. (1010° C.) followed by an air cool.

Austenitizing step: Next, the samples were (i) charged into a furnace below about 500° F. (260° C.); (ii) heated at a rate of about 300° F. (149° C.) per hour maximum to about 1725° F. (940° C.) to about 1775° F. (968° C.) and (iii) held for about 30 minutes per inch of thickness at about 1750° F. (954° C.), and then the samples were water quenched to below 125° F. (52° C.).

Tempering step: Next the samples were (i) placed in a furnace below about 400° F. (204° C.), and were tempered within 24 hours of quenching by (ii) heating the samples at a maximum of about 400° F. (204° C.) per hour and holding the samples at about 400° F. (204) for a minimum of about 60 min per in of sample size, and (iii) allowing the samples to cool in air at room temperature.

Example 4

Another portion of the 2.5" thick ring samples of AF9628 composition (B) were thermally processed using the following process:

Normalizing step: (i) Charging the samples into a furnace below about 500° F. (260° C.); (ii) heating the samples at a maximum rate of about 300° F. (149° C.) per hour to temperature of about 1825° F. (996° C.) to about 1875° F. (1024° C.); (iii) holding the samples for about 30 minutes per inch of thickness at about 1850° F. (1010° C.), and (iv) followed by an air cool.

Subcritical temperature annealing step: (i) Charging the samples into a furnace below about 500° F. (260° C.); (ii) heating the samples at a maximum rate of about 300° F. (149° C.) per hour to temperature of about 1225° F. (663° C.) to about 1275° F. (691° C.); (iii) holding the samples for at least 4 hours at 1250° F. (677° C.); and (iv) followed by an air cool.

Austenitizing step: (i) Charging the samples into a furnace below about 500° F. (260° C.); (ii) heating the samples at a rate of about 300° F. (149° C.) per hour maximum to about 1825° F. (996° C.) to about 1875° F. (1024° C.); (iii) holding the samples for about 30 minutes per inch of thickness at about 1850° F. (1010° C.); and (iv) water-quenching to below about 125° F. (52° C.).

Tempering step: (i) Charging the samples into a furnace below about 400° F. (204° C.), and tempered within 24 hours of quenching by (ii) heating the samples at a maximum of about 400° F. (204° C.) per hour; (iii) holding the samples at about 400° F. (204° C.) for a minimum of about 60 min/in of sample size; and (iv) allowing the samples to cool in air at room temperature.

Example 5

A sample of AF9628 composition (B) was then rolled from ingots into about 15" diameter bar. Blind-ended items were made from this heat, which weighed greater than about 2,000 lbs and had a wall thickness about 1.5". The sample was coated with NO-CARB™ anti-decarburization, anti-scale paint (Park Metallurgical Corporation, Detroit, Mich.). The sample of AF9628 composition (B) was thermally processed using the following process:

Normalizing step: (i) Charging the sample into a furnace below about 500° F. (260° C.); (ii) heating the sample at a maximum rate of about 300° F. (149° C.) per hour to a temperature of about 1825° F. (996° C.) to about 1875° F. (1024° C.); (iii) holding the sample at about 1850° F. (1010° C.) for at least 1 hour, with no allowance for NO-CARB™; and (iv) allowing the sample to cool in air.

Subcritical temperature annealing step: (i) Charging the sample into a furnace below about 500° F. (260° C.); (ii) heating the sample at a maximum rate of about 300° F. (149° C.) per hour to temperature of about 1225° F. (663° C.) to about 1275° F. (691° C.); (iii) holding the sample for at least 4 hours at 1250° F. (677° C.); and (iv) allowing the sample to cool in air.

Austenitizing step: (i) Charging the sample into a furnace below about 500° F. (260° C.); (ii) heating the sample at a rate of about 300° F. (149° C.) per hour maximum to about 1825° F. (996° C.) to about 1875° F. (1024° C.); (iii) holding the sample at about 1850° F. (1010° C.) for about 30 minutes per inch of thickness (1 hour minimum); and (iv) thermally quenching with a heavy spray quench with water to below about 125° F. (52° C.).

Tempering step: (i) Changing the sample into a furnace below about 400° F. (204° C.), and tempered within 24 hours of quenching by (ii) heating the sample at a maximum of about 400° F. (204° C.) per hour; (iii) holding the sample at about 400° F. (204° C.) for a minimum of about 60 min/in of sample size; and (iv) allowing the sample to cool in air at room temperature.

Composition (C)—Argon-Oxygen Decarburization/Vacuum Arc Remelting

Another heat of AF9628 was produced according to the composition provided in Table 4 using an Argon-Oxygen Decarburization+Vaccuum Arc Remelting (AOD-VAR) technique to provide the AF9628 composition (C). The materials/ingredients were melted together to form Composition C in a 52,000 lb lb. production heat. Samples of Composition (C) were then forged from ingots into about 15" diameter production bars from and cut into about 2.5" thick ring sections from the outer diameter. Composition C was used in Example 6.

TABLE 4

AF9628 Composition (C) used in Example 6.

| C (%) | Mn (%) | P (%) | S (%) | Si (%) | Cr (%) | Ni (%) | Mo (%) | Al (%) | Cu (%) | V (%) | Fe (%) | N (ppm) |
|---|---|---|---|---|---|---|---|---|---|---|---|---|
| 0.27 | 0.63 | 0.005 | 0.001 | 0.93 | 2.79 | 1.03 | 0.94 | 0.008 | 0.03 | 0.07 | Bal | 25 |

Example 6

A sample of AF9628 composition (C) was then forged from ingots into about 15" diameter bar. Ring shaped items were fabricated and had a wall thickness of about 2.5". The sample was coated with NO-CARB™ anti-decarburization, anti-scale paint (Park Metallurgical Corporation, Detroit, Mich.). The sample of AF9628 composition (C) was thermally processed using the following process:

Normalizing step: (i) Charging the sample into a furnace below about 500° F. (260° C.); (ii) heating the sample at a maximum rate of about 300° F. (149° C.) per hour to a temperature of about 1825° F. (996° C.) to about 1875° F. (1024° C.); (iii) holding the sample at about 1850° F. (1010° C.) for at least 1 hour, with no allowance for NO-CARB™; and (iv) allowing the sample to cool in air.

Subcritical temperature annealing step: (i) Charging the sample into a furnace below about 500° F. (260° C.); (ii) heating the sample at a maximum rate of about 300° F. (149° C.) per hour to temperature of about 1225° F. (663° C.) to about 1275° F. (691° C.); (iii) holding the sample for at least 4 hours at 1250° F. (677° C.); and (iv) allowing the sample to cool in air.

Austenitizing step: (i) Charging the sample into a furnace below about 500° F. (260° C.); (ii) heating the sample at a rate of about 300° F. (149° C.) per hour maximum to about 1825° F. (996° C.) to about 1875° F. (1024° C.); (iii) holding the sample at about 1850° F. (1010° C.) for about 30 minutes per inch of thickness (1 hour minimum); and (iv) thermally quenching with a heavy spray quench with water to below about 125° F. (52° C.).

Tempering step: (i) Changing the sample into a furnace below about 400° F. (204° C.), and tempered within 24 hours of quenching by (ii) heating the sample at a maximum of about 400° F. (204° C.) per hour; (iii) holding the sample at about 400° F. (204° C.) for a minimum of about 60 min/in of sample size; and iv) allowing the sample to cool in air at room temperature.

Composition (D)—Casting

A smaller heat of AF9628 was produced via induction melting with an argon spall cover. The materials/ingredients listed in Table 5 were melted together to form Composition D in an approximately 1000 lb. production heat. Samples of Composition (D) were then cast into shape tensile coupons per the investment casting method. Composition D was used in Example 7.

TABLE 5

AF9628 Composition (D) used in Example 7.

| C (%) | Mn (%) | P (%) | S (%) | Si (%) | Cr (%) | Ni (%) | Mo (%) | Al (%) | Cu (%) | V (%) | Fe (%) | N (ppm) |
|---|---|---|---|---|---|---|---|---|---|---|---|---|
| 0.26 | 0.54 | 0.013 | 0.001 | 1.04 | 2.81 | 1.05 | 0.99 | 0.007 | 0.146 | 0.06 | Bal | N/A |

Example 7

Composition D samples were re-melted in induction furnace with argon cover before being cast into a plate approximately 8"×1"×1". After casting, the test coupon samples were subjected to hot isostatic processing (HIP) at about 2125° F. for about 3 hours to about 4 hours, at about 15 ksi, followed by an argon cool.

The test wedge samples of Composition D were separated into 1" specimens and heat treated with the following schedule:

Subcritical temperature annealing step: (i) Charging the sample into a furnace below about 500° F. (260° C.); (ii) heating the sample at a maximum rate of about 300° F. (149° C.) per hour to temperature of about 1175° F. (635° C.) to about 1225° F. (663° C.); (iii) holding the sample for at least 4 hours at 1200° F. (649° C.); and (iv) allowing the sample to cool in air.

Austenitizing step: (i) Charging the sample into a furnace below about 500° F. (260° C.); (ii) heating the sample at a rate of about 300° F. (149° C.) per hour maximum to about 1825° F. (996° C.) to about 1875° F. (1024° C.); (iii) holding the sample at about 1850° F. (1010° C.) for about 30 minutes per inch of thickness (1 hour minimum); and (iv) quenching into room temperature agitated water to below about 125° F. (52° C.).

Tempering step: (i) Changing the sample into a furnace below about 400° F. (204° C.), and tempered within 24 hours of quenching by (ii) heating the sample at a maximum of about 400° F. (204° C.) per hour; (iii) holding the sample at about 400° F. (204° C.) for about 4 hours; and (iv) allowing the sample to cool in air at room temperature.

Composition (E)—Casting

Production Heat #1—Investment Cast Heat produced by Metaltek. Data is from standard 1" test bars that follow along the specimen.

TABLE 6

| AF9628 Composition (E) used in Example 8 | | | | | | | | | | | | |
|---|---|---|---|---|---|---|---|---|---|---|---|---|
| C (%) | Mn (%) | P (%) | S (%) | Si (%) | Cr (%) | Ni (%) | Mo (%) | Al (%) | Cu (%) | V (%) | Fe (%) | N (ppm) |
| 0.28 | 0.63 | 0.007 | 0.003 | 0.94 | 2.64 | 0.99 | 0.93 | 0.005 | 0.02 | 0.08 | Bal | 0.015 |

* The AF9628 Composition (E) also included 0.004% niobium.

Example 8

Alloys were melted in induction furnace with argon cover before being casted into test coupons about 1" in diameter. After casting, the test coupon samples were subjected to hot isostatic processing (HIP) at 2125° F. (1163° C.), for about 3 hours to about 4 hours, at about 15 ksi, followed by an argon cool.

Subcritical temperature annealing step: (i) Charging the sample into a furnace below about 500° F. (260° C.); (ii) heating the sample at a maximum rate of about 300° F. (149° C.) per hour to temperature of about 1175° F. (635° C.) to about 1225° F. (663° C.); (iii) holding the sample for at least 4 hours at 1200° F. (649° C.); and (iv) allowing the sample to cool in air.

Austenitizing step: (i) Charging the sample into a furnace below about 500° F. (260° C.); (ii) heating the sample at a rate of about 300° F. (149° C.) per hour maximum to about 1825° F. (996° C.) to about 1875° F. (1024° C.); (iii) holding the sample at about 1850° F. (1010° C.) for about 1 hour; and (iv) thermally quenching with an agitated oil to below about 125° F. (52° C.).

Tempering step: (i) Changing the sample into a furnace below about 400° F. (204° C.), and tempered within 24 hours of quenching by (ii) heating the sample at a maximum of about 400° F. (204° C.) per hour; (iii) holding the sample at about 400° F. (204° C.) for about 4 hours; and (iv) allowing the sample to cool in air at room temperature.

The exemplary compositions (Compositions A-E) of AF9628, in conjunction with the disclosed processing condition, result in low alloy steel(s) with the following exemplary properties in ultimate tensile strength (UTS), yield strength (YS), elongation to failure (EF) tested as per ASTM E8, Charpy V-notch (CVN) impact toughness at −40° C. as per ASTM E23, and Rockwell Hardness (RH) C-Scale. The results of these tests are presented in Table 5 below:

TABLE 5

| Physical Properties of heat treated samples of AF9628 | | | | | |
|---|---|---|---|---|---|
| Example | Ultimate Tensile Strength (ksi) | Yield Strength, 0.2% Offset (ksi) | Elongation to Failure (%) | Impact Toughness CVN −40F/C (ft-lbs) | Hardness Rockwell C-Scale |
| Example 1 | | | | | |
| Avg. | 250.1 | 194.6 | 14.5 | 29.0 | 48.7 |
| Std Dev | 1.7 | 2.2 | 0.5 | 1.4 | 0.6 |
| Example 2 | | | | | |
| Avg. | 245.9 | 189.2 | 12.1 | 27.8 | 48.7 |
| Std Dev | 1.8 | 2.4 | 1.8 | 1.1 | 0.9 |
| Example 3 | | | | | |
| Avg. | 247.1 | 189.9 | 12.1 | 24.5 | 49.3 |
| Std Dev | 1.0 | 1.5 | 0.8 | 1.0 | 1.2 |
| Example 4 | | | | | |
| Avg | 246.0 | 187.5 | 12.4 | 28.5 | 49.3 |
| Std Dev | 1.2 | 1.2 | 0.7 | 1.4 | 1.5 |

TABLE 5-continued

| Physical Properties of heat treated samples of AF9628 | | | | | |
|---|---|---|---|---|---|
| Example | Ultimate Tensile Strength (ksi) | Yield Strength, 0.2% Offset (ksi) | Elongation to Failure (%) | Impact Toughness CVN −40F/C (ft-lbs) | Hardness Rockwell C-Scale |
| Example 5 | | | | | |
| Avg | 246.3 | 190.1 | 13.7 | 31.5* | 49.8 |
| Std Dev | 1.4 | 1.7 | 0.7 | 4.8* | 1.5 |
| Example 6 | | | | | |
| Avg | 241.2 | 183.5 | 11.4 | 33.2* | 48.0 |
| Std Dev | 2.4 | 2.8 | 0.9 | 3.4 | 0.5 |
| Example 7 | | | | | |
| Avg | 236.0 | 183.1 | 14.1 | ~ | 51.3 |
| Std Dev | 1.0 | 3.4 | 0.3 | | 3.3 |
| Example 8 | | | | | |
| Avg | 236.7 | 184.6 | 13.7 | 27.5 | 48.7 |
| Std Dev | 0.3 | 0.7 | 0.5 | ~ | 0.9 |

*Includes transverse data.

In view of the foregoing, the heat treatment steps for AF9628 may be generalized as follows: 1) austenitizing at about 1750° F. (954° C.) or higher (e.g., about 1850° F. (1010° C.)); 2) high rate polymer/water quench for section thicknesses up to 2.5"; 3) tempering at less than 500° F. (260° C.) (e.g., about 450° F. (232° C.) or lower, preferably 385° F. (196° C.) to 410° F. (210° C.)). Steps 2 and 3 are targeted to preferentially grow stable ε-carbides and have them remain stable during and throughout processing. Many of the undesirable carbides for the penetrator type applications require significant driving force/energy, and therefore time at temperature to form. To avoid these undesirable carbide phases, cooling from step 1 (i.e., austenitizing step) is performed very quickly. For example, a water or polymer quench is used for samples of AF9628 having a thickness greater than about 1". For these samples having a thickness greater than about 1", an oil quench, as is typically practiced, has shown to be too slow. In step 3, a low temperature tempering is to reduce the driving force for the formation of the more stable, undesirable carbides (i.e., typical tool-steel alloy carbides, such as $M_{23}C_6$, $M_2C$, and $M_6C$ carbides).

ε-Carbide Details

With reference to FIG. 1, the ε-carbides (or epsilon carbides) have an approximate size of about 100 nm to about 150 nm in length, and about 10 nm in width. The epsilon carbides have a shape similar to feathery rods that are semi-coherent (fit-within) the matrix, causing localized strain features within the matrix. Without being bound by any particular theory, the configuration of epsilon carbide is believed to be $Fe_{2.4}C$, hexagonal close packed in crystal configuration, which is substantially different to $Fe_3C$ (a slightly larger) carbide that that generally forms in the prior art alloy steel compositions when they are tempered at too high of a temperature. Epsilon carbide is thermally unstable, so tempering is performed at temperatures less than about 500° F. (260° C.) (e.g., about 475° F. (246° C.) or less, or about 450° C. (232° C.) or less) in these compositions to provide the desired physical properties. Again, without being bound by any particular theory, epsilon carbide is believed to provide strength, while preserving dynamic toughness. The distribution (in the primarily martensitic matrix, rather than at grain boundaries) promotes this favorable combination of properties.

Steels with a combination of a plurality of the foregoing physical properties (i.e., UTS, YS, EF, CVN, RH) and with very low amount of expensive alloying elements are attractive not only for penetrator and munitions type applications but will also find utility in areas including pressure vessels, aircraft parts with high specific strength (strength to weight ratio) requirements, such as mining/drilling and petroleum applications, automotive/locomotive vehicle parts and structural equipment used in low temperature applications.

CORROSION RESISTANCE: No formal corrosion resistance testing has been performed on AF9628. However, the corrosion resistance is expected be similar to 2.25Cr-1 Mo and A1514330 steels, and thus the AF 9628 material is not expected to be substantially corrosion resistant. Therefore, the use of plating, paint, or other anti-corrosion coatings is warranted, if exposure to atmospheres that would induce corrosion is anticipated. Further, low hydrogen techniques/hydrogen bake-out may be required as per the relevant AMS/MIL specifications.

Figure 2:
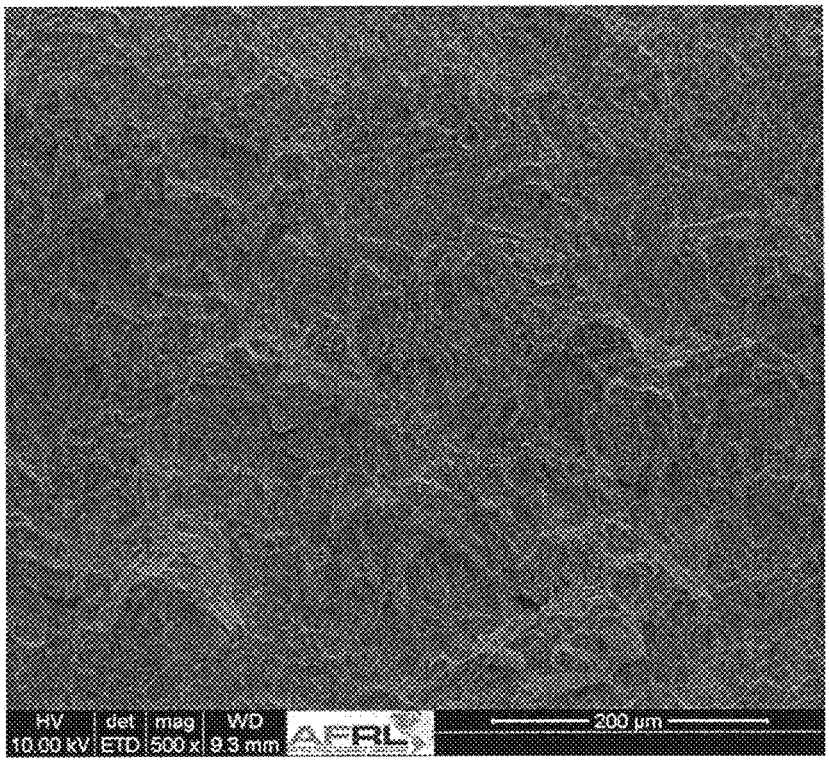
FIG. 2 is a scanning electron micrograph taken at 500× showing a general fracture surface from a Charpy V-notch (CVN) test sample tested @−40° C., in accordance with an embodiment of the present invention.
Figure 3:
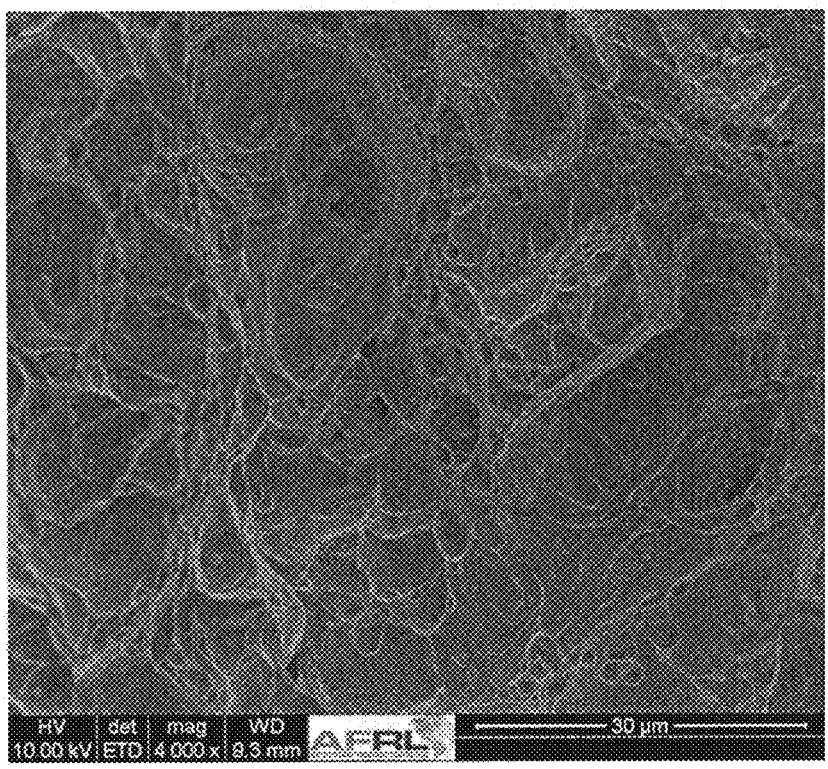
FIG. 3 is a scanning electron micrograph taken at 4,000× showing a general fracture surface from a Charpy V-notch (CVN) test sample tested @−40° C., in accordance with an embodiment of the present invention.
Figure 4:
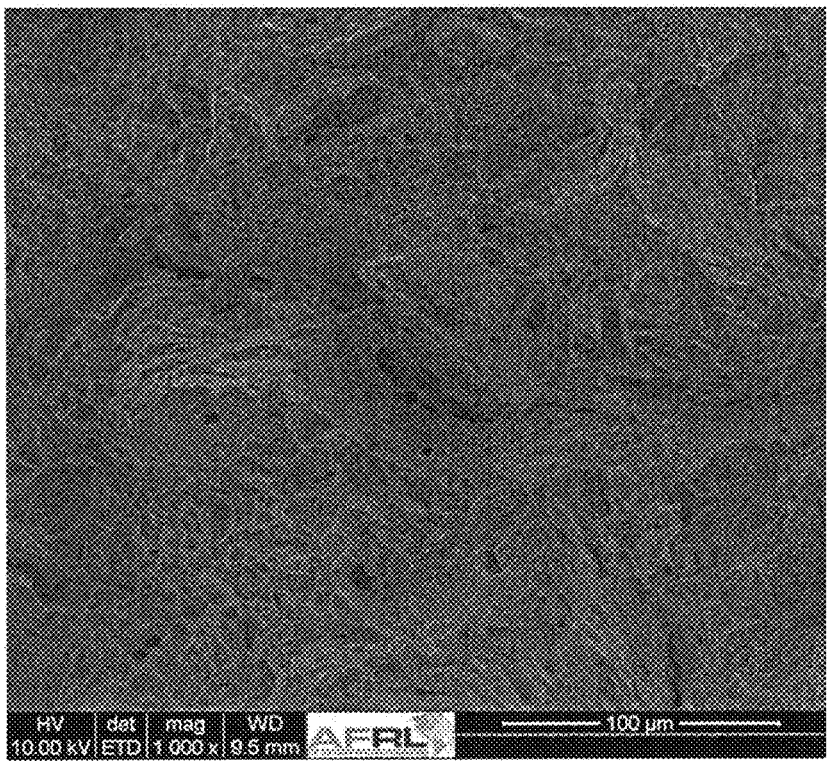
FIG. 4 is a scanning electron micrograph taken at 1,000× showing a fracture surface from a Tensile Test sample, in accordance with an embodiment of the present invention.
Figure 5:
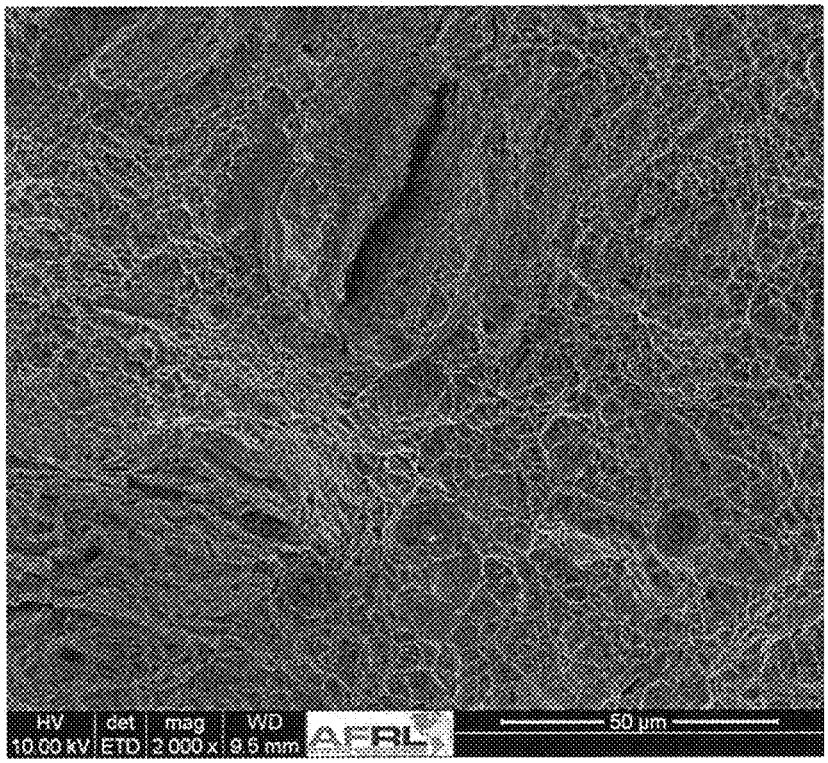
FIG. 5 is a scanning electron micrograph taken at 2,000× showing a fracture surface showing an oxide inclusion from a Tensile Test sample, in accordance with an embodiment of the present invention

With reference to FIGS. 2 and 3, scanning electron micrographs (SEMs) taken at 500× and 4,000×, respectively, show general fracture surfaces from a Charpy V-notch (CVN) test sample tested @−40° C. In FIG. 4, an SEM taken at 1,000× shows a fracture surface from a Tensile Test sample, and in FIG. 5 an SEM taken at 2,000× shows a fracture surface, with an oxide inclusion, from a Tensile Test sample.

Figure 6:
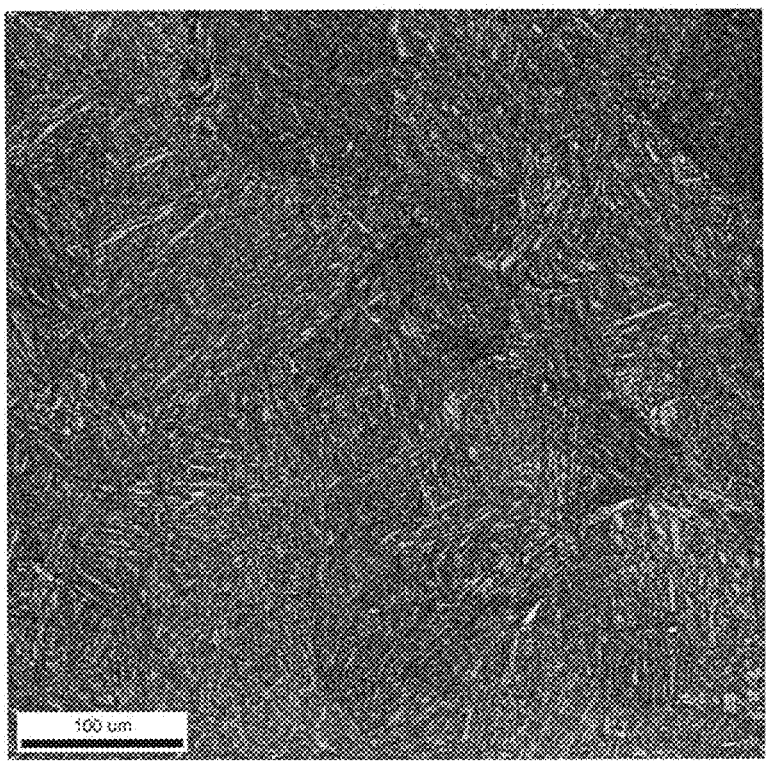
FIG. 6 shows Electron Back-Scatter Diffraction (EBSD) data collected using a Scanning Electron Microscope (SEM) taken at 500× with a 700 nm step, in accordance with an embodiment of the present invention.
Figure 7:
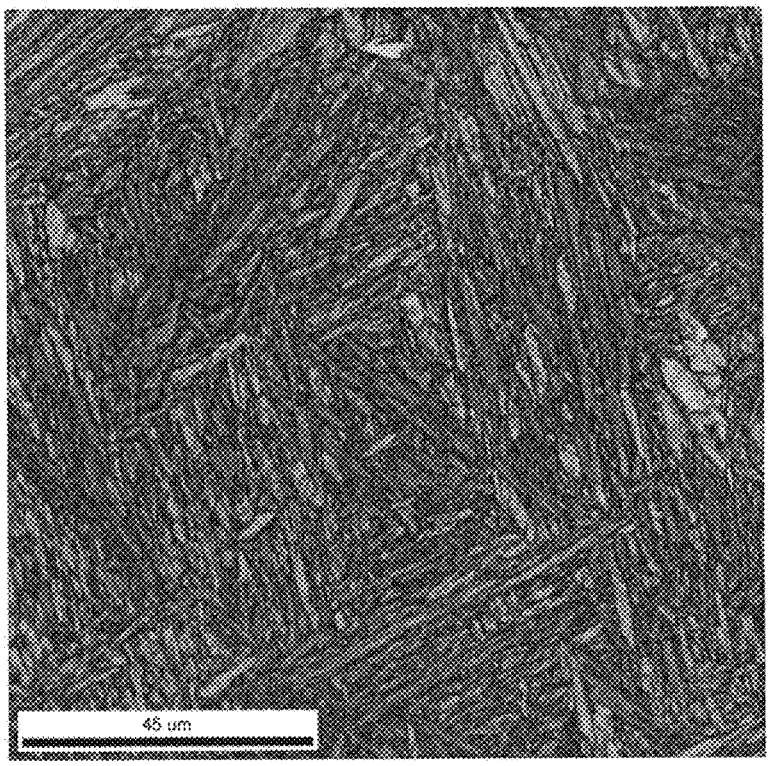
FIG. 7 shows Electron Back-Scatter Diffraction (EBSD) data collected using a Scanning Electron Microscope (SEM) taken at 2,000× with a 200 nm step, in accordance with an embodiment of the present invention.
Figure 8:
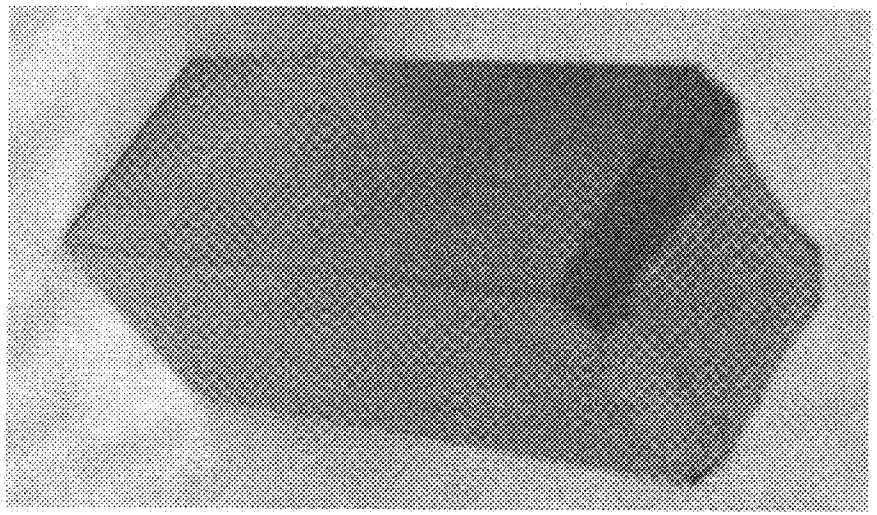
FIG. 8 is photograph showing a Charpy V-notch (CVN) test sample, tested @−40° C., that yielded a value of about 29 ft-lbs, in accordance with an aspect of the present invention.

In FIG. 6, Electron Back-Scatter Diffraction (EBSD) data, which was conducted using a Scanning Electron Microscope (SEM) taken at 500× with a 700 nm step, is shown. The EBSD-SEM technique is used to shown microstructural-crystallographic character. And FIG. 7 shows EBSD-SEM data taken at 2,000× with a 200 nm step. And FIG. 8 is photograph showing a Charpy V-notch (CVN) test sample, tested @−40° C., that yielded a value of about 29 ft-lbs, As used herein and in the appended claims, the singular forms "a", "an" and "the" include plural reference unless the context clearly dictates otherwise. As well, the terms "a" (or "an"), "one or more" and "at least one" can be used interchangeably herein. It is also to be noted that the terms "comprising", "including", "characterized by" and "having" can be used interchangeably.

While the present invention has been illustrated by the description of one or more embodiments thereof, and while the embodiments have been described in considerable detail, they are not intended to restrict or in any way limit the scope of the appended claim to such detail. Additional advantages and modification will be readily apparent to those skilled in the art. The invention in its broader aspects is therefore not limited to the specific details, representative compositions, and methods and illustrative examples shown and described. Accordingly, departures may be made from such details without departing from the scope or the spirit of the general inventive concept exemplified herein.

What is claimed is:

1. An alloy steel composition consisting of:
about 0.26% to about 0.30% carbon,
about 2.20% to about 2.80% chromium,
about 0.75% to about 1.25% molybdenum,
about 0.05% to about 0.25% vanadium,
about 0.10% to about 0.90% manganese,
about 0.50% to about 2.50% nickel,
about 0.50% to about 1.25% silicon,
about 0.20% copper or less,
about 0.015% phosphorous or less,
about 0.012% sulfur or less,
about 0.02% calcium or less,
about 0.15% nitrogen or less,
about 0.025% aluminum or less, and
balance being iron and unavoidable impurities, wherein % is weight percent based on the entire weight of the alloy steel composition.

2. The alloy steel composition of claim 1, consisting of:
about 0.26% to about 0.29% carbon,
about 2.50% to about 2.80% chromium,
about 0.85% to about 1.05% molybdenum,
about 0.05% to about 0.15% vanadium,
about 0.50% to about 0.80% manganese,
about 0.90% to about 1.20% nickel, and
about 0.90% to about 1.10% silicon.

3. The alloy steel composition of claim 1, wherein the sulfur content is about 0.005% or less, the copper content is about 0.15%, or less and the aluminum content is about 0.015% or less.

4. The alloy steel composition of claim 1, consisting of: about 0.28% carbon, about 2.52% chromium, about 0.91% molybdenum, about 0.06% vanadium, about 0.62% manganese, about 0.95% nickel, about 0.96% silicon, about 0.01% copper, about 0.002% phosphorous, about 0.004% sulfur, about 0.006% nitrogen, and about 0.014% aluminum.

5. The alloy steel composition of claim 1, consisting of: about 0.27% carbon, about 2.74% chromium, about 0.95% molybdenum, about 0.05% vanadium, about 0.58% manganese, about 1.00% nickel, about 1.00% silicon, about 0.15% copper, about 0.008% phosphorous, about 0.001% sulfur, about 0.005% nitrogen, and about 0.015% aluminum.

6. The alloy steel composition of claim 1, wherein the composition has at least one of the following properties:
an ultimate tensile strength of 200 ksi to 250.1 ksi;
a yield strength at 0.2% offset of 170 ksi to 194.6 ksi;
an elongation to failure of 10% to 14.5%;
an impact toughness as measured by a Charpy V-notch test @ −40° C. of 20 ft-lbs to 33.2 ft-lbs; or
a Hardness Rockwell C-scale of 45 to 49.8.

7. The alloy steel composition of claim 6, further comprising a mixture of epsilon nano-carbides having a length of about 100 nm to about 150 nm in a matrix of martensite, which may optionally comprise a minor fraction of bainite.

8. The alloy steel composition of claim 1, wherein the composition is void of any typical tool-steel alloy carbides selected from the group consisting of $M_{23}C_6$, $M_2C$, and $M_6C$ carbides.

9. A bomb component comprising the alloy steel composition of claim 1.

10. An ingot having a solidified volume, comprising the alloy steel composition of claim 1.

11. A method of thermally processing the alloy steel composition of claim 1, comprising:
a. austenitizing a sample of the alloy steel composition by heating the sample to an austenitizing temperature that is above a critical temperature to form an austenite mixture;
b. lowering the austenite mixture to a temperature below a martensitic-forming temperature to provide an austenitized alloy steel composition; and
c. tempering the austenitized alloy steel composition, comprising:
i. heating the austenitized alloy steel composition to a tempering temperature, which is in a tempering temperature range that is less than about 500° F. (260° C.) but greater than about 350° F. (177° C.);

ii. maintaining the alloy steel composition in the tempering temperature range for a first duration that is dependent upon a thickness and a length of the sample of the alloy steel composition; and iii. lowering the alloy steel composition to an ambient temperature.

12. The method of claim 11, wherein the critical temperature is about 1750° F. (954° C.) or higher; and wherein the martensitic-forming temperature is about 150° F. (66° C.) or lower.

13. The method of claim 11, wherein the austenitizing temperature is at or above a carbide dissolution temp of about 1825° F. (996° C.).

14. The method of claim 11, wherein austenitizing the sample of the alloy steel composition further comprises:

i. heating the alloy steel composition to the austenizing temperature, which is in an austenitizing temperature range from about 1825° F. (996° C.) to about 1875° F. (1024° C.), at a rate of about 300° F. (149° C.) per hour or less;

ii. maintaining the alloy steel composition in the austenitizing temperature range for a second duration that is dependent upon the thickness and the length of the sample of the alloy steel composition; and iii. quenching the alloy steel composition from the austenizing temperature range to a temperature of about 150° F. (66° C.) or less in liquid quenchant selected from the group consisting of water, an aqueous solution, an oil, a polymer liquid, and combinations thereof.

15. The method of claim 11, further comprising normalizing the sample of the alloy steel composition prior to austenitizing, comprising:

i. heating the alloy steel composition to a normalizing temperature range that is about 1825° F. (996° C.) to about 1875° F. (1024° C.);

ii. maintaining the alloy steel composition within the normalizing temperature range for a third duration that is dependent upon the thickness and the length of the sample of the alloy steel composition; and iii. allowing the alloy steel composition to air cool from the normalizing temperature range.

16. The method of claim 11, further comprising providing a subcritical treatment to the alloy steel composition prior to austenitizing, comprising:

i. heating the alloy steel composition to a subcritical temperature, which is in a subcritical temperature range from about 1225° F. (663° C.) to about 1275° F. (691° C.), at a rate of about 300° F. (149° C.) per hour or less;

ii. maintaining the alloy steel composition within the subcritical temperature range for a fourth duration that is dependent upon the thickness and the length of the sample of the alloy steel composition; and iii. quenching the sample of the alloy steel composition from the subcritical temperature range to about 150° F. (149° C.) or below in a liquid quenchant selected from the group consisting of water, an aqueous solution, an oil, a polymer liquid, and combinations thereof.

17. The method of claim 11, wherein lowering the alloy steel composition to an ambient temperature is performed by air cooling.

* * * * *